US005806223A

United States Patent [19]

Visagie

[11] Patent Number: 5,806,223

[45] Date of Patent: Sep. 15, 1998

[54] SHADOW BOX OR BOX FRAME UNIT

[75] Inventor: André W Visagie, Pretoria, South Africa

[73] Assignee: Shadow Box Systems (Proprietary) Limited, Johannesburg, South Africa

[21] Appl. No.: 454,506

[22] Filed: May 30, 1995

[30] Foreign Application Priority Data

May 27, 1994 [ZA] South Africa ..... 94/3710
Jul. 5, 1994 [ZA] South Africa ..... 94/4831

[51] Int. Cl.[6] ..... A47G 1/06

[52] U.S. Cl. ..... 40/800; 40/757

[58] Field of Search ..... 40/160, 152, 152.1, 40/154, 800, 740, 743, 757; 206/557, 518, 519; 220/669, 670, 672, 675; D9/418

[56] References Cited

U.S. PATENT DOCUMENTS 1,590,779 9/1926 Michlinski et al. ..... 40/800
3,082,903 3/1963 Stevens et al. .
4,383,607 5/1983 Lordahl et al. .
4,512,474 4/1985 Harding .
5,037,000 8/1991 Salame .

FOREIGN PATENT DOCUMENTS 3705400 9/1988 Germany .
U-88 13 389 1/1989 Germany .
A-593561 12/1977 Switzerland .
2116122 9/1983 United Kingdom ..... 40/800

*Primary Examiner*—Cassandra H. Davis
*Attorney, Agent, or Firm*—Darby & Darby

[57] ABSTRACT

A display unit suitable for use in providing box frames or shadow boxes. The unit is preferably of integral plastics construction and comprises stepped side walls which form a main compartment, the side walls having front and rear peripheral edges with a mounting formation in the form of a flange projecting outwardly from the front edge and a rear formation, preferably in the form of a rear panel, extending inwardly from the rear edge. Additional mounting formations arc provided in the side walls, between, and spaced apart from the front and rear peripheral edges. Several units may be coupled in series to form a deeper unit. Grooves may be provided in the rear surfaces of the stepped side walls to trim the unit to a smaller size.

12 Claims, 3 Drawing Sheets

FIG. 1
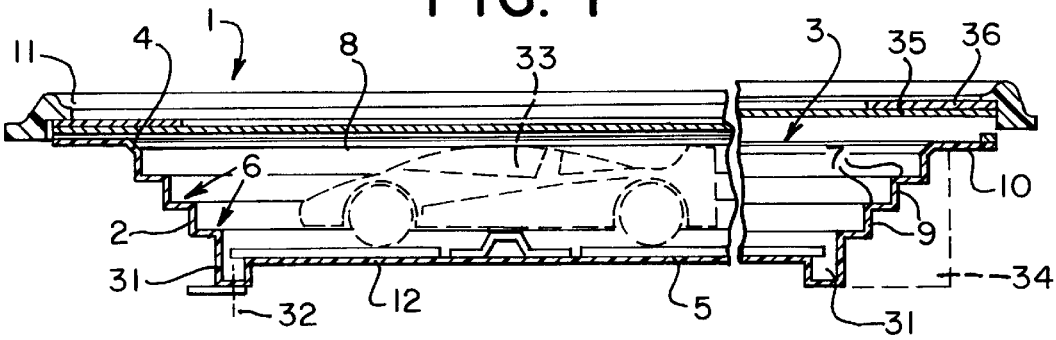
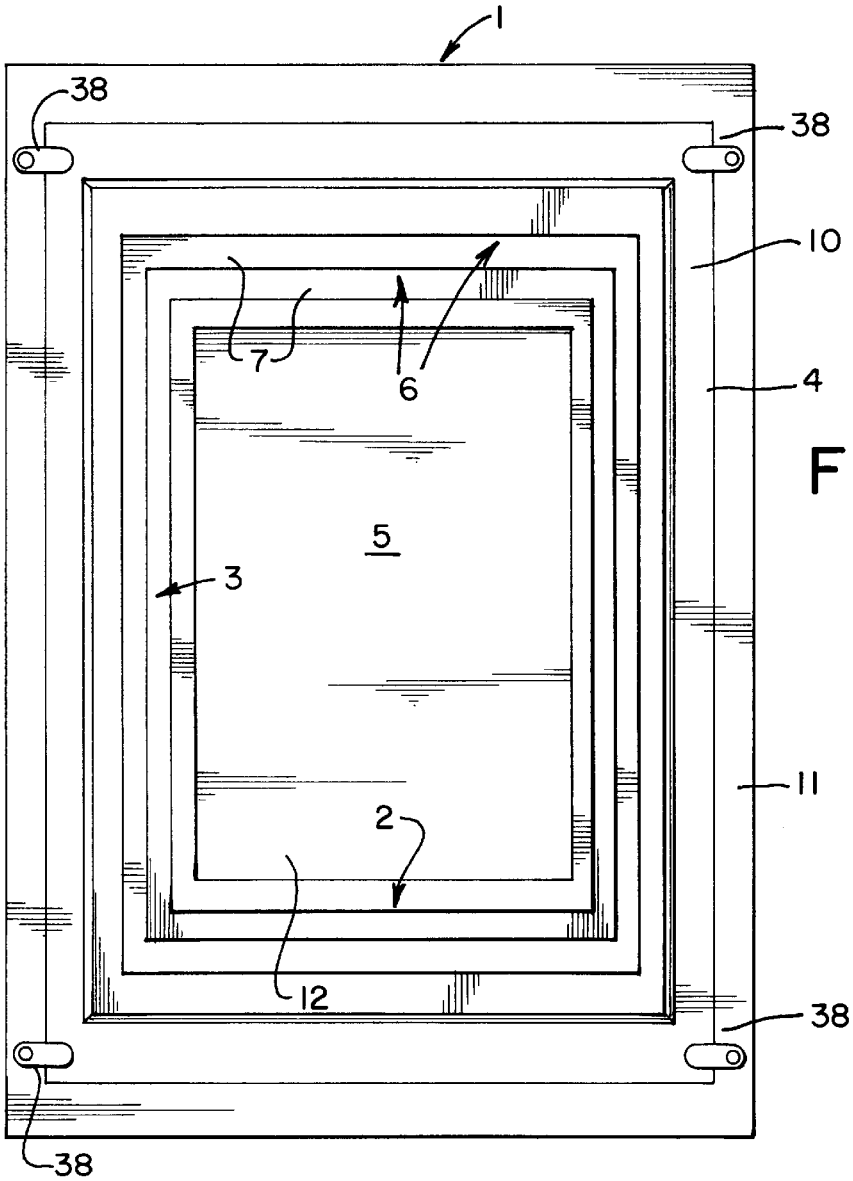
FIG. 2

SHADOW BOX OR BOX FRAME UNIT

INTRODUCTION TO THE INVENTION

This invention relates to a shadow box or box frame unit suitable for use in framing articles.

BACKGROUND TO THE INVENTION

In the art of framing it is often necessary or desirable to frame articles which are non-planar and which thus must be framed in a frame which accommodates their depth as well as their height and width.

Standard frames or mouldings are manufactured to accommodate substantially two dimensional articles such as paintings, drawings, prints and the like, and for this reason must be adapted to accommodate three dimensional articles. The framer generally achieves this by building a custom made box, often referred to as a "shadow box", in which the article is located. The shadow box is generally constructed from wood and thus while it can be made from a size point of view to suit the article, it is a time consuming and hence costly exercise.

Once the box has been made it can be decorated, the article mounted therein and thereafter fixed with a glass front to the rear of a suitable frame.

OBJECT OF THE INVENTION

An object of the invention is to provide a shadow box unit which is suitable for use in box framing and which provides for easier box framing than the method described above.

SUMMARY OF THE INVENTION

According to the invention a shadow box unit is of integral construction and comprises side walls forming a main compartment, the side walls having a front and a rear peripheral edge and at least one mounting formation projecting outwardly from the front edge.

Further, according to the invention, the unit includes a rear formation extending inwardly from the rear edge.

Still further, according to the invention, the mounting formation is a peripheral front flange.

Still further, according to the invention, the rear formation may be a rear peripheral flange and the rear flange is adapted to provide a mount for a rear panel for the unit.

Still further, according to the invention, the rear formation may be a rear panel.

Still further, according to the invention, at least the rear panel includes reinforcing formations, preferably grooves therein.

Still further, according to the invention, the side walls include formations spaced from the front and rear edges in the depth thereof and extending around the side walls.

Still further, according to the invention, there are preferably at least two mounting formations at spaced intervals in the depth of the side walls.

Still further, according to the invention, the mounting formations are in the form of continuous steps in the side walls, the steps extending for the entire perimeter of the side walls and extending inwardly to progressively decrease the area of the inside of the unit from the front edge to the rear edge thereof.

Still further, according to the invention, any of the flanges and any of the steps may each include at least one continuous demarcation extending around the main compartment.

Still further, according to the invention, the unit includes at least one continuous substantially perimetrical demarcation in at least the front flange and each of the portions of the steps parallel to the flange around the front edge.

Still further, according to the invention, the demarcation is in the form of a groove or perforation.

Still further, according to the invention, the unit includes at least one recess for accommodating a hanging device.

Still further, according to the invention, the unit includes at least one hanging device, the device including a member adapted to be fixed into the recess in the unit and means for attaching elongated flexible elements to the member.

Still further, according to the invention, the unit includes at least one ancillary compartment which compartment is located on the side wall outside of the main compartment and having at least one aperture communicating with the main compartment.

Still further, according to the invention, the unit includes an opening with a closure therefor and the opening is located in one of the sidewall or rear panel.

Still further, according to the invention, the side walls have one of a rectangular, polygonal, circular and oval configuration.

Still further, according to the invention, the unit is of plastics material.

Still further, according to the invention, the unit includes a frame for location at the front edge and securable to the mounting formation.

Still further, according to the invention, the frame has a formation for accommodating a front transparent member.

Still further, according to the invention, the unit is of plastics material and the frame is mounted at the front edge by a plastics type of hinge.

BRIEF DESCRIPTION OF THE DRAWINGS

Embodiments of the invention described by way of example only follow with reference to the accompanying drawings in which FIG. 1 is a sectional elevation of a first embodiment of a shadow box unit and frame;

FIG. 2 is a rear view of the shadow box unit and frame of FIG. 1;

DETAILED DESCRIPTION OF THE DRAWINGS

Figure 3:
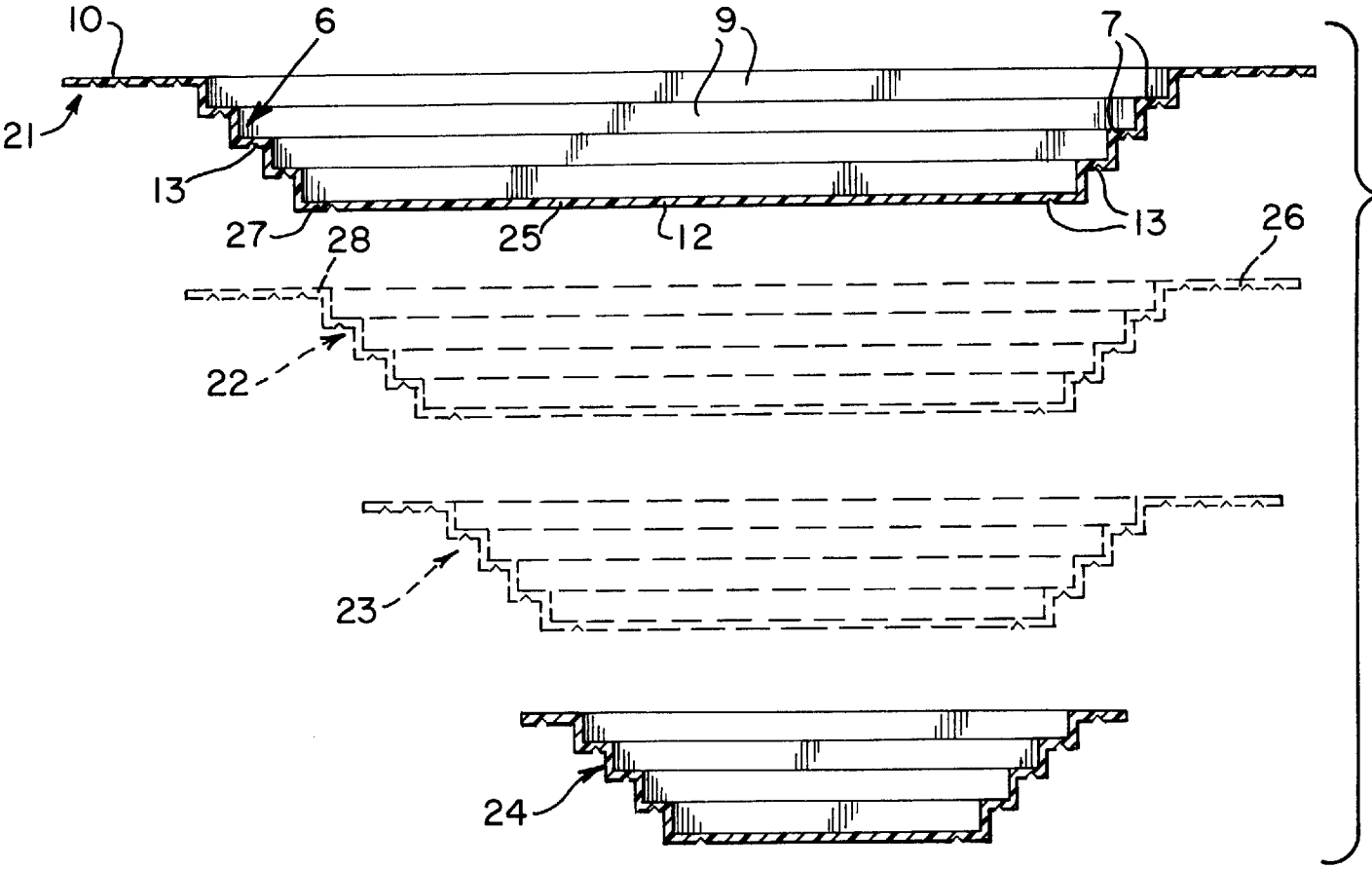
FIG. 3 depicts in schematic cross-sectional elevation of a series of display units.

In the first embodiment of the invention a shadow box unit (1) is provided.

The unit (1) is made from black plastics material and is either vacuum formed or injection moulded.

As may be seen from FIGS. 1 and 2 of the drawings the unit (1) is of generally rectangular shape and comprises side walls (2) and (3) which form a main compartment and which have a front edge (4) and a rear edge (5). The front edge has a chamfered or flattened configuration.

The side walls (2) and (3) have a "stepped" configuration in that they have a series of three equally spaced steps (6) between the front and rear edges (4) and (5). These steps are continuous around the perimeter of the side walls and comprise continuous flat surfaces (7) which project into the main compartment (8) with each of the flat surfaces (7) being separated by angled transverse portions (9).

The stepped configuration of the side walls (2) and (3) thus gives the compartment (8) and the unit (1) as a whole a tapered or frusto-pyramidal type of configuration.

Around the front edge (4) of the side walls (2) and (3) is a peripheral flange (10) which is adapted to be secured to a frame (11) in the manner described hereunder, and thus may be considered a frame mounting formation.

Extending from the rear edge (5) to close the rear of the compartment (8) is a rear panel (12).

Referring to FIG. 3 of the drawings both the front peripheral flange (10) as well as each of the surfaces (7) of the step formations (6) and the rear panel (12) are provided with continuous demarcations in the form of perforations or "V" shaped grooves (13) in the rear surfaces thereof. The purpose of these grooves (13) is to act as guides for the blade of a knife used to trim the unit or cut it down to a smaller size. Thus the width of the flange (10) may be decreased or the depth of the compartment may be decreased by tracing a knife around a suitable groove and removing a portion of the unit. Similarly, the rear panel may be removed.

Removal of the rear panel may be important where it is desired to create a deeper shadow box unit from two or more different sized units as shown in FIG. 3 where a series of four units (21), (22), (23) and (24) is shown.

A deep unit may be created, for example, by combining units (21) and (22) by first removing the back panel of (25) of unit (21) (as described above) and removing the major portion of the flange (26) of unit (22). The remaining rear flange portion (27) of unit (21) may then be glued in known manner to the remaining front flange portion (28) of unit (22).

In similar fashion three or four units may be joined together or any pair of adjacent units may be joined together.

The unit (1) is provided with reinforcing in the form of grooves or ribs in the rear panel (12) as well as in the front flange (10). This is desirable for increasing the stiffness of the unit with a view to minimising the thickness and hence cost of the material required.

For hanging the unit on a wall, for example, the unit is provided with recesses (31) to which mounting members (32) may be mounted by screws passing through the material of the unit. These mounting members (32) include apertures for locating over a fastener projecting from a wall for example or for use in attaching a suitable flexible member as is well known in the art of picture framing.

In use, a suitably sized shadow box unit (1) or combination of display units as described above is chosen. An article (33) to be displayed is mounted in the shadow box unit in any of a variety of suitable ways, many of which are also well known in the art of framing. For example, an article may be mounted on the rear panel 12, as shown in FIG. 1, and/or along side walls 2 and 3. If an object is mounted along the side walls, a single or series of mount boards may be used either abutting each other or located on different stepped formations (6), which may be considered mounting formations. Furthermore, where there is more than one article or where an article has different parts these may be mounted at different depths within the shadow box unit using the same facilities of the stepped formations (6). Where it is desired to cover the stepped formation this may be done with mount board suitably cut and glued to the chamfered front edge (4).

Where it is important to provide lighting or movement of the article, the shadow box unit may be provided with an ancillary compartment indicated by dotted lines and numeral 34. This ancillary compartment may be used to house lighting or motor drives for example and may be provided with a small access door. An ancillary compartment may also be provided by placing the rear panel at a position spaced inwardly from the rear edge.

When the article (33) to be displayed has been mounted in the shadow box unit (1) the shadow box unit (1) is mounted to the frame (11) with a transparent member such as a sheet of glass (35) sandwiched between the flange (10) and the internal rebate surface (36) of the frame (11).

The shadow box unit (1) may be mounted permanently (for example by stapling) or semi-permanently to the frame or alternatively may be mounted thereto by way of retaining members (38) as shown in FIG. 2.

Figure 4:
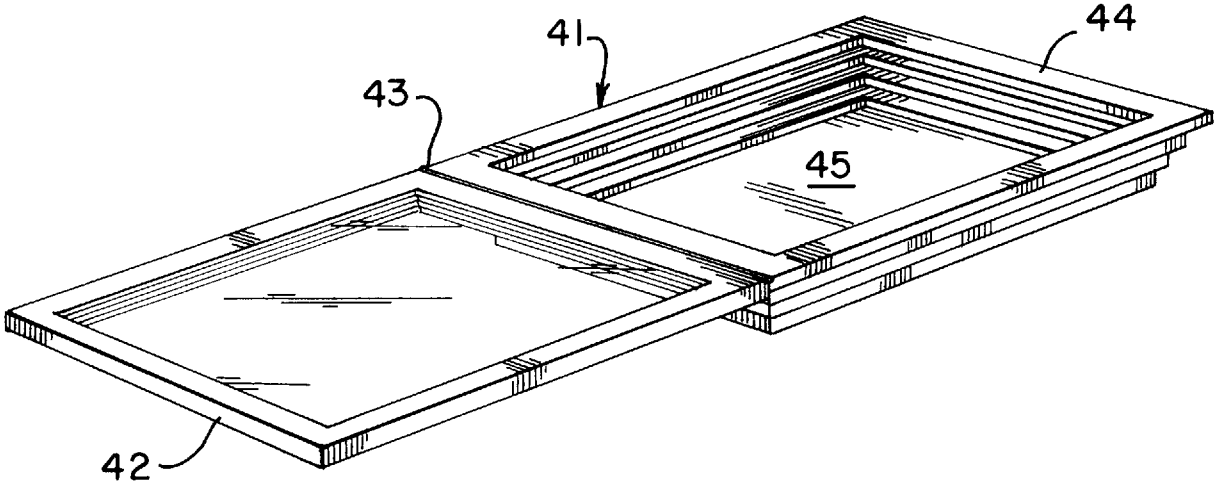
FIG. 4 is a view of an alternative embodiment of a shadow box unit and integral frame.

A second embodiment of the invention is shown in FIG. 4. In this embodiment a shadow box unit (41) is integrally attached to a frame (42) by means of a hinge (43) along one edge of the front flange (44) thereof.

Conveniently, the unit (41) and frame (42) are moulded together and the hinge (43) is a "plastics hinge".

In this way once an article has been mounted in the compartment (45) of the shadow box unit (41) a sheet of glass may be located on the flange (44) and the frame (42) closed. Conveniently the frame is provided with formations for locating the glass and also with a suitable catch for engaging with the flange (44) of the shadow box unit (41).

The invention thus provides a shadow box unit which is used for providing box frames or shadow boxes and which is versatile and easy to use in comparison with prior art which comprised of making a suitably sized box from wood or the like.

Other embodiments are envisaged within the scope of the invention including other shapes of the display units such as polygonal, oval or round shapes as well as other materials of manufacture.

I claim:

1. A shadow box unit for displaying a three-dimensional article in a substantially centrally located article display area within said unit said shadow box unit comprising:

tapered side walls formed of a unitary piece of plastic material having a front edge and a rear edge, said tapered side walls forming a main compartment having an inner, substantially centrally located article display area of sufficient depth to display a three-dimensional article substantially centrally within the confines of said side walls;

a front peripheral edge extending from said front edge of said side walls;

a rear peripheral edge extending from said rear edge of said side walls; and at least one article mounting formation formed on said side walls between and spaced from said front edge, and said rear edge of said side walls, said article mounting formation adapted for mounting and displaying a three-dimensional article within the confines of said side walls in said substantially centrally located article display area within said unit for unobstructed viewing, said unit further including reinforcing formations.

2. A unit as claimed in claim 1 in which the reinforcing formations are grooves.

3. A shadow box unit for displaying a three-dimensional article in a substantially centrally located article display area within said unit, said shadow box unit comprising:

tapered side walls formed of a unitary piece of plastic material having a front edge and a rear edge, said tapered side walls forming a main compartment having an inner, substantially centrally located article display area of sufficient depth to display a three-dimensional article substantially centrally within the confines of said side walls;

a front peripheral edge extending from said front edge of said side walls;

a rear peripheral edge extending from said rear edge of said side walls; and a plurality of article mounting formations formed in said side walls between and spaced from said front edge and said rear edge of said side walls in the depth thereof, said article mounting formation adapted for mounting and displaying a three-dimensional article within the confines of said side walls in said substantially centrally located article display area within said unit for unobstructed viewing, where said article mounting formations are in the form of a plurality of continuous steps in said side walls, said steps extending for the entire perimeter of said side walls and extending inwardly to progressively decrease the area of said article display area from said front edge to said rear edge thereof.

4. A shadow box unit for displaying a three-dimensional article in a substantially centrally located article display area within said unit, said shadow box unit comprising:

tapered side walls having a front edge and a rear edge, said tapered side walls forming a main compartment having an inner, substantially centrally located article display area of sufficient depth to display a three-dimensional article substantially centrally within the confines of said side walls;

a front peripheral edge extending from said front edge of said side walls;

a rear peripheral edge extending from said rear edge of said side walls further comprising a rear panel coupled to said rear peripheral edge;

at least one article mounting formation formed on said side walls between and spaced from said front edge and said rear edge of said side walls, said article mounting formation adapted for mounting a three-dimensional article within the confines of said side walls in said substantially centrally located article display area within said unit;

wherein said article mounting formations are in the form of a plurality of continuous steps in said side walls, said steps extending for the entire perimeter of said side walls and extending inwardly to progressively decrease the area of said article display area from said front edge to said rear edge thereof; at least one of said steps including at least one continuous demarcation extending around said main compartment;

at least one of said steps includes at least one continuous demarcation extending around said main compartment.

5. A unit as claimed in claim 4 in which the demarcation is one of a groove and perforations.

6. A shadow box unit for displaying a three-dimensional article in a substantially centrally located article display area within said unit, said shadow box unit comprising:

tapered side walls having a front edge and a rear edge, said tapered side walls forming a main compartment having an inner substantially centrally located article display area of sufficient depth to display a three-dimensional article substantially centrally within the confines of said side walls;

a front peripheral edge extending from said front edge of said side walls;

a rear peripheral edge extending from said rear edge of said side walls;

at least one article mounting formation formed on said side walls between and spaced from said front edge and said rear edge of said side walls said article mounting formation adapted for mounting a three-dimensional article within the confines of said side walls in said substantially centrally located article display area within said unit;

wherein said at least one frame mounting formation is a peripheral flange;

wherein said front flange includes at least one continuous demarcation extending around said main compartment.

7. A unit as claimed in claim 4 in which said steps have a portion parallel to said rear panel, said unit further including at least one continuous perimetrical demarcation in an least said rear panel and each of the portions of the steps parallel to the said rear panel.

8. A shadow box unit for displaying a three-dimensional article in a substantially centrally located article display area within said unit, said shadow box unit comprising:

tapered side walls formed of a unitary piece of plastic material having a front edge and a rear edge, said tapered side walls forming a main compartment having an inner, substantially centrally located article display area of sufficient depth to display a three-dimensional article substantially centrally within the confines of said side walls;

a front peripheral edge extending from said front edge of said side walls;

a rear peripheral edge extending from said rear edge of said side walls; and at least one article mounting formation formed on said side walls between and spaced from said front edge and said rear edge of said side walls, said article mounting formation adapted for mounting and displaying a three-dimensional article within the confines of said side walls in said substantially centrally located article display area within said unit for unobstructed viewing, said unit further including an opening with a closure therefor.

9. A shadow box unit for displaying a three-dimensional article in a substantially centrally located article display area within said unit, said shadow box unit comprising:

tapered side walls formed of a unitary piece of plastic material having a front edge and a rear edge, said tapered side walls forming a main compartment having an inner, substantially centrally located article display area of sufficient depth to display a three-dimensional article substantially centrally within the confines of said side walls;

a front peripheral edge extending from said front edge of said side walls and a frame mounting formation projecting outwardly from said front peripheral edge;

a rear peripheral edge extending from said rear edge of said side walls; and at least one article mounting formation formed on said side walls between and spaced from said front edge and said rear edge of said side walls said article mounting formation adapted for mounting and displaying a three-dimensional article within the confines of said side walls in said substantially centrally located article display area within said unit for unobstructed viewing;

a frame having a formation for accommodating a front transparent member; and a front transparent member mounted between said frame mounting formation and said frame, said front transparent member having a transparent center permitting viewing of a three-dimensional article mounted substantially in the center of said unit within the confines of and spaced apart from said side walls.

10. A shadow box for displaying a three-dimensional article in a substantially centrally located article display area within said shadow box, said shadow box including a first unit and a second unit, said first unit comprising:

stepped side walls having a front edge and a rear edge, said stepped side walls forming a main compartment having an inner, substantially centrally located object display area of sufficient depth to display a three-dimensional article substantially centrally within the confines of said side walls;

a front peripheral edge extending from said front edge of said side walls;

a rear peripheral edge extending from said rear edge of said side walls;

at least one article mounting formation formed in said side walls between said front edge and said rear edge of said side walls, said article mounting formation adapted for mounting a three-dimensional article within the confines of said side walls in said substantially centrally located article display area within said first unit;

and at least one frame mounting formation projecting outwardly from said front peripheral edge; said second unit comprising:

second stepped side walls having a front edge and a rear edge, said second stepped side walls forming a main compartment;

a front peripheral edge extending from said front edge of said second side walls;

a rear peripheral edge extending from said rear edge of said second side walls;

a rear panel extending from said rear edge of said second side walls; and at least one article mounting formation in one of said rear panel and said second side walls between said front edge and said rear edge of said second side walls;

wherein said front peripheral edge of said second unit is coupled to the rear peripheral edge of said first unit so that said main compartment of said second unit increases the depth of said first unit.

11. A unit as claimed in claim 10 in which at least one of said steps and said rear panel of at least one of said first defined unit and said additional unit includes a continuous demarcation extending around said main compartment such that said unit may be cut along said continuous demarcation to adjust the width or depth of said main compartment.

12. A shadow box unit for displaying a three-dimensional article in a substantially centrally located article display area within said unit, said shadow box unit comprising:

tapered side walls formed of a unitary piece of plastic material having a front edge and a rear edge, said tapered side walls forming a main compartment having an inner, substantially centrally located article display area of sufficient depth to display a three-dimensional article substantially centrally within the confines of said side walls;

a front peripheral edge extending from said front edge of said side walls and a frame mounting formation projecting outwardly from said front peripheral edge;

a rear peripheral edge extending from said rear edge of said side walls, at least one article mounting formation formed on said side walls between and spaced from said front edge and said rear edge of said side walls, said article mounting formation adapted for mounting and displaying a three-dimensional article within the confines of said side walls in said substantially centrally located article display area within said unit for unobstructed viewing; and a frame having a formation for accommodating a front transparent member.

* * * * *